US009335691B2

(12) United States Patent
Yamagishi et al.

(10) Patent No.: US 9,335,691 B2
(45) Date of Patent: May 10, 2016

(54) FIXING DEVICE AND IMAGE FORMING APPARATUS

(71) Applicant: KYOCERA Document Solutions Inc., Osaka (JP)

(72) Inventors: Yoshihiro Yamagishi, Osaka (JP); Yoshiharu Kanematsu, Osaka (JP); Takashi Eiki, Osaka (JP); Hironori Takahashi, Osaka (JP); Takefumi Yotsutsuji, Osaka (JP); Eriko Hayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/721,685

(22) Filed: May 26, 2015

(65) Prior Publication Data

US 2015/0346663 A1 Dec. 3, 2015

(30) Foreign Application Priority Data

May 28, 2014 (JP) ..... 2014-109728

(51) Int. Cl.
*G03G 15/20* (2006.01)

(52) U.S. Cl.
CPC ..... *G03G 15/2064* (2013.01); *G03G 15/2039* (2013.01); *G03G 15/2053* (2013.01); *G03G 2215/2035* (2013.01)

(58) Field of Classification Search
CPC ..... G03G 15/2017; G03G 15/2078; G03G 21/1685; G03G 21/2022; G03G 21/2025
See application file for complete search history.

(56) References Cited

U.S. PATENT DOCUMENTS

2004/0057759 A1* 3/2004 Ogiso ..... G03G 15/2064 399/329
2006/0157464 A1* 7/2006 Omata ..... G03G 15/2057 219/216
2013/0209125 A1 8/2013 Uchitani et al.
2014/0086648 A1* 3/2014 Maruyama ..... G03G 15/2053 399/329
2015/0104230 A1 4/2015 Uchitani et al.

FOREIGN PATENT DOCUMENTS

JP 2013-164438 A 8/2013
JP 5409060 B2 * 2/2014

OTHER PUBLICATIONS

JP_5409060_B2_T Abstract; Feb. 5, 2014, Japan.*

* cited by examiner

*Primary Examiner* — Clayton E Laballe
*Assistant Examiner* — Victor Verbitsky
(74) *Attorney, Agent, or Firm* — Studebaker & Brackett PC

(57) ABSTRACT

A fixing device includes a fixing belt, a pressuring member, a pressing member and a temperature sensor. The fixing belt is arranged rotatably. The pressuring member is arranged rotatably and configured to come into pressure contact with the fixing belt so as to form a fixing nip. The pressing member is configured to press the fixing belt to the pressuring member side. The temperature sensor is inserted into the pressing member. The pressing member has a through hole penetrating from a face at the fixing nip side to an insertion part of the temperature sensor.

8 Claims, 10 Drawing Sheets

FIXING DEVICE AND IMAGE FORMING APPARATUS

INCORPORATION BY REFERENCE

This application is based on and claims the benefit of priority from Japanese patent application No. 2014-109728 filed on May 28, 2014, the entire contents of which are incorporated herein by reference.

BACKGROUND

The present disclosure relates to a fixing device fixing a toner image onto a recording medium and an image forming apparatus including the fixing device.

Conventionally, an electrographic image forming apparatus, such as a copying machine, a printer, a facsimile or a multifunction peripheral, includes a fixing device fixing a toner image onto a recording medium, such as a sheet.

For example, there is a fixing device including a fixing belt, a pressuring member configured to come into pressure contact with the fixing belt so as to form a fixing nip, a pressing member configured to press the fixing belt to the pressuring member side and a temperature sensor configured to detect a temperature of the fixing belt.

In the fixing device with such a configuration, there is a case that the temperature sensor is arranged so as to face an area opposite to the fixing nip of the fixing belt. In such a case, it is difficult for the temperature sensor to accurately detect temperature of a part at the fixing nip side of the fixing belt or temperature of a member arranged between the fixing belt and the pressing member.

SUMMARY

In accordance with an embodiment of the present disclosure, a fixing device includes a fixing belt, a pressuring member, a pressing member and a temperature sensor. The fixing belt is arranged rotatably. The pressuring member is arranged rotatably and configured to come into pressure contact with the fixing belt so as to form a fixing nip. The pressing member is configured to press the fixing belt to the pressuring member side. The temperature sensor is inserted into the pressing member. The pressing member has a through hole penetrating from a face at the fixing nip side to an insertion part of the temperature sensor.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
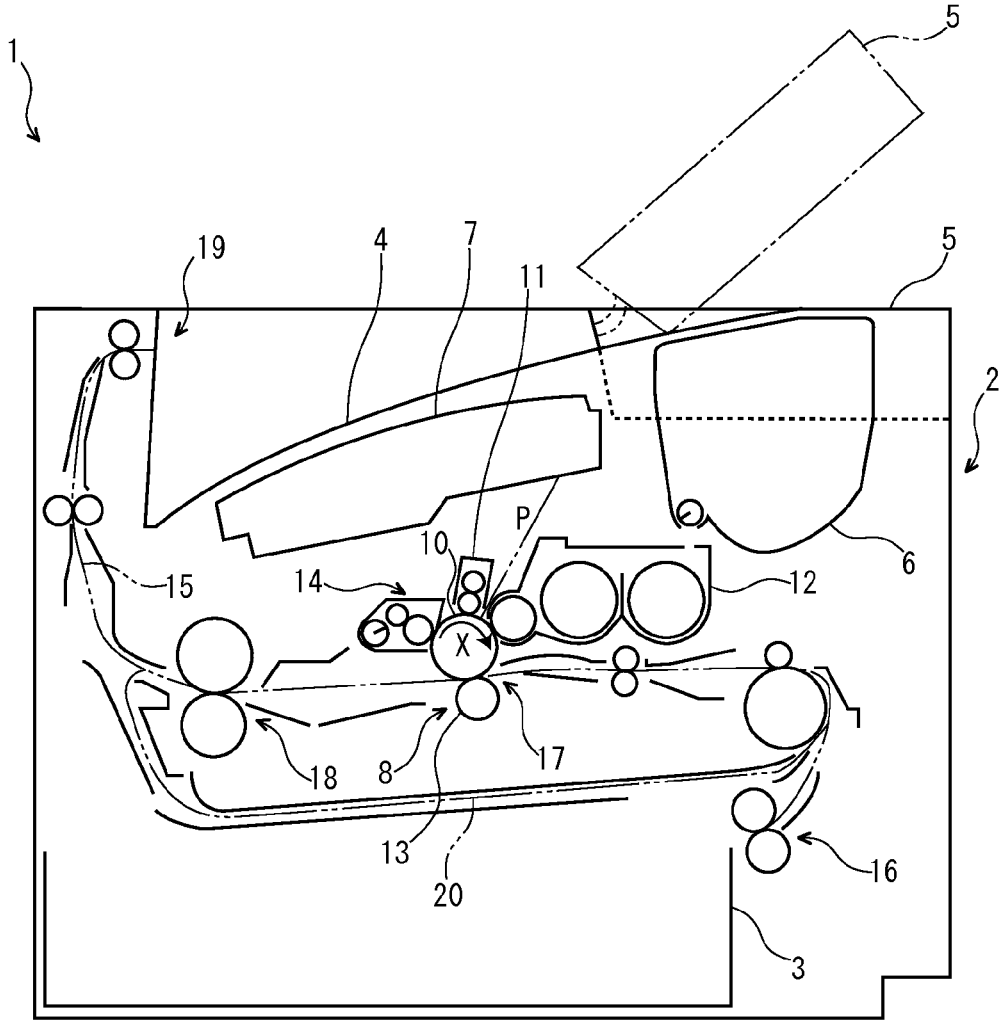
FIG. 1 is a schematic diagram schematically showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is arranged below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are arranged along a rotating direction (refer to an arrow X in FIG. 1) of the photosensitive drum 10.

Inside the printer main body 2, a conveying path 15 for the sheet is arranged. At an upstream end in the conveying path 15, a sheet feeding part 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10.

Subsequently, the development device 12 develops the electrostatic latent image to a toner image by a toner (a developer).

On the other hand, a sheet picked up from the sheet feeding cartridge 3 by the sheet feeding part 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, the fixing device 18 will be described in detail. Hereinafter, it will be described so that the front side of the fixing device 18 is positioned at the near side of FIG. 2, for convenience of explanation. Arrows Fr, Rr, L, R, U and Lo of each figure indicate a front side, a rear side, a left side, a right side, an upper side and a lower side of the fixing device 18, respectively. An arrow Y of each figure indicates a conveying direction of the sheet (in the embodiment, left and right directions).

Figure 2:
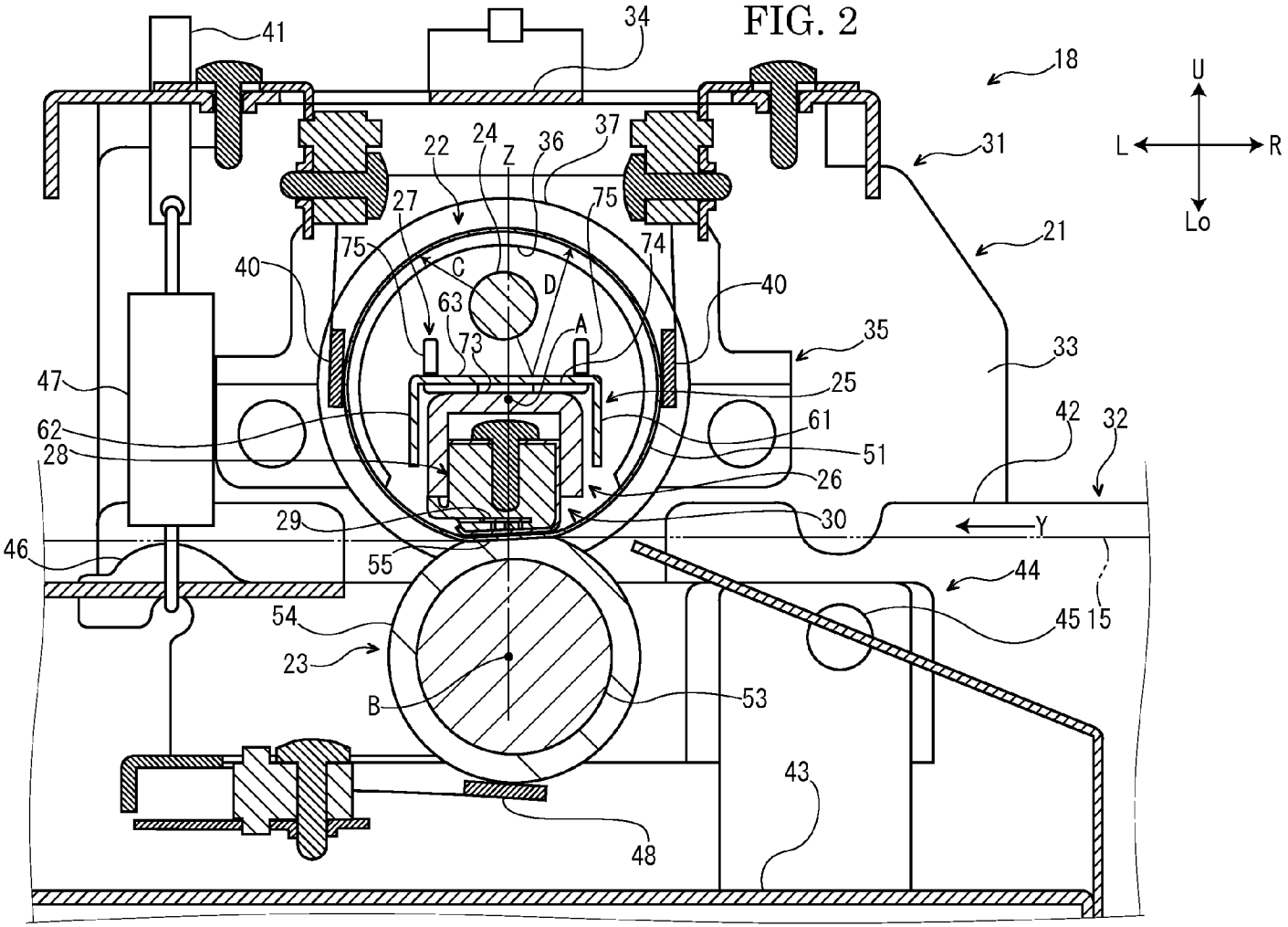
FIG. 2 is a sectional view showing a fixing device according to the embodiment of the present disclosure.

As shown in FIG. 2 and other figures, the fixing device 18 includes a box-like formed fixing frame 21, a fixing belt 22, a pressuring roller 23 (a pressuring member), a heater 24 (a heat source), a reflecting member 25, a supporting member 26, spacers 27, pressing member 28, a pair of front and rear temperature sensors 29 and a sheet member 30. The fixing belt 22 is installed in an upper part of the fixing frame 21. The pressuring roller 23 is installed in a lower part of the fixing frame 21. The heater 24 is arranged at an inner circumferential side of the fixing belt 22. The reflecting member 25 is arranged at the inner circumferential side of the fixing belt 22 and at a lower side of the heater 24. The supporting member 26 is arranged at the inner circumferential side of the fixing belt 22 and at a lower side of the reflecting member 25. The spacers 27 are arranged at front and rear end sides of the reflecting member 25, respectively. In FIG. 2, the front spacer 27 is omitted. The pressing member 28 is arranged at the inner circumferential side of the fixing belt 22 and at a lower side of the supporting member 26. The pair of front and rear temperature sensors 29 are inserted into the pressing member 28. In FIG. 2, the rear temperature sensor 29 is omitted. The sheet member 30 is arranged between the fixing belt 22 and the pressing member 28.

The fixing frame 21 (refer to FIG. 2) is made of a plate metal. The fixing frame 21 is composed of an upper frame part 31 and a lower frame part 32 connected to each other.

The upper frame part 31 of the fixing frame 21 includes a pair of front and rear upper end plates 33 and a top plate 34 connecting upper end parts of the front and rear upper end plates 33. In FIG. 2, the front upper end plate 33 is omitted.

To an inner face of each upper end plate 33 of the upper frame part 31, belt attachment base 35 is fixed. The belt attachment base 35 is provided with arc-like belt supporting part 36. Around outer circumference of the belt supporting part 36, annular meandering restriction ring 37 is arranged.

To both right and left side parts of the top plate 34 of the upper frame part 31, first thermistors 40 are fixed. Each first thermistor 40 comes into contact with an outer circumferential face of the fixing belt 22. To a left end part of the top plate 34, a pair of front and rear adjustment members 41 are attached in a movable state in an upper and lower direction. In FIG. 2, the front adjustment member 41 is omitted.

The lower frame part 32 of the fixing frame 21 includes a pair of front and rear lower end plates 42 and a bottom plate 43 connecting lower parts of the front and rear lower end plates 42. In FIG. 2, the front lower end plate 42 is omitted.

To an inside in the front and rear direction of the front and rear lower end plates 42 of the lower frame part 32, swing frames 44 are arranged. At a right end side of each swing frame 44, a fulcrum part 45 is arranged. At a left end side of each swing frame 44, an attachment part 46 is arranged. The attachment part 46 is connected to the adjustment member 41 of the upper frame part 31 via a coil spring 47 and the adjust member 41 moves in the upper and lower direction so that each swing frame 44 swings around the fulcrum part 45. To the lower frame part 32, a second thermistor 48 is fixed. The second thermistor 48 comes into contact with an outer circumferential face of the pressuring roller 23.

Figure 3:
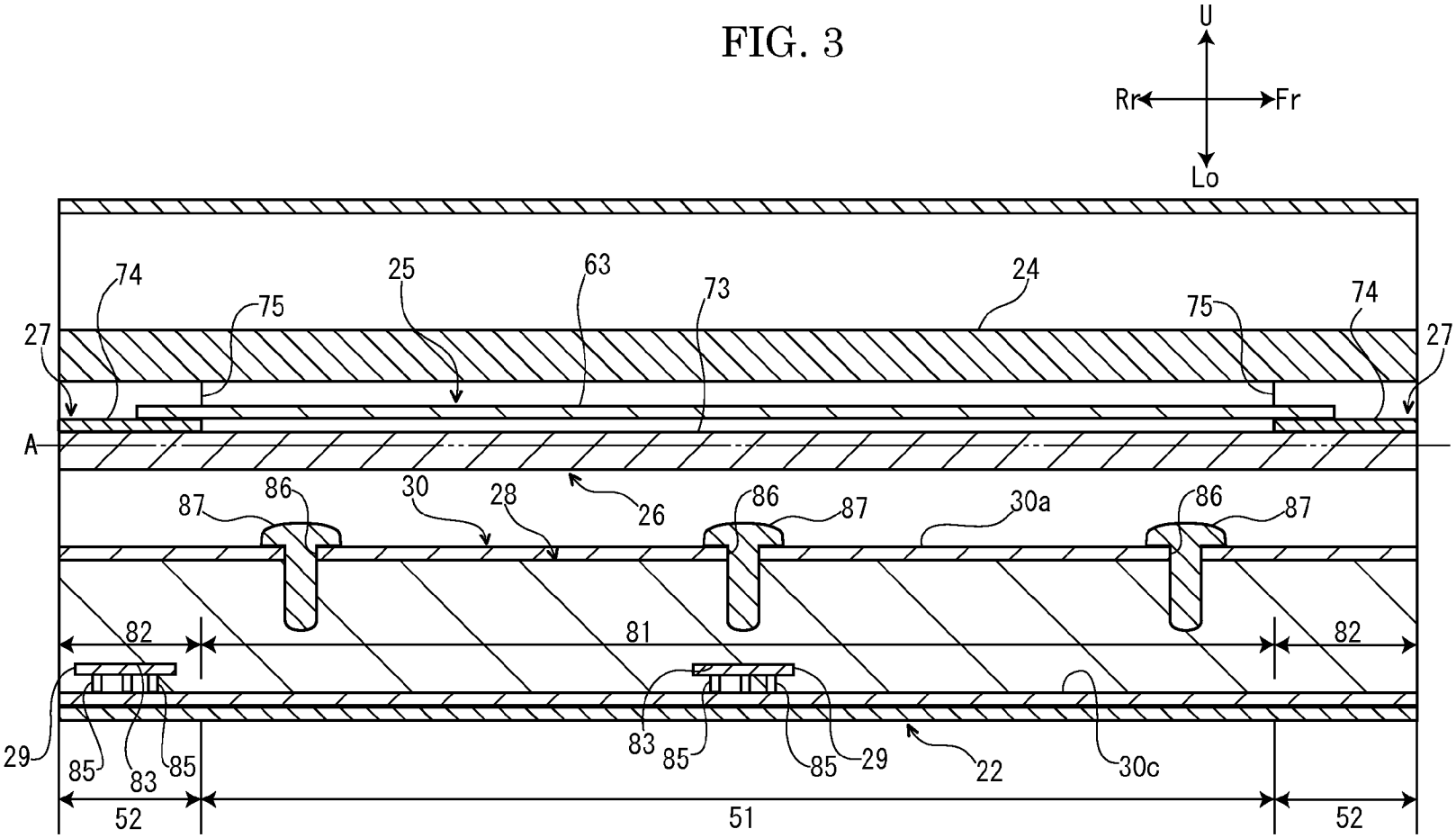
FIG. 3 is a sectional view showing a fixing belt and members arranged at an inner circumferential side of the fixing belt, in the fixing device according to the embodiment of the present disclosure.

The fixing belt 22 (refer to FIGS. 2 and 3) is formed in a roughly cylindrical shape elongated in the front and rear direction. The fixing belt 22 has flexibility and is formed in an endless shape in a circumferential direction. The fixing belt 22 includes, for example, a base material layer, an elastic layer provided around the base material layer and a release layer covering the elastic layer. The base material layer of the fixing belt 22 is made of, for example, metal, such as steel special use stainless (SUS). Incidentally, the base material layer of the fixing belt 22 may be made of resin, such as polyimide (PI). The elastic layer of the fixing belt 22 is made of, for example, a silicone rubber. The release layer of the fixing belt 22 is made of, for example, perfluoro alkoxy alkane (PFA) tube. Each figure shows the respective layers (the base material layer, the elastic layer and the release layer) of the fixing belt 22 without distinguishing.

Into both front and rear end parts of the fixing belt 22, the belt supporting part 36 formed in each belt attachment base 35 of the upper frame part 31 is inserted. Thereby, the fixing belt 22 is rotatably supported by the upper frame part 31. The fixing belt 22 is rotatable around a rotation axis A extending in the front and rear direction. That is, in the embodiment, a rotation axis direction of the fixing belt 22 is the front and rear direction. Both front and rear end faces of the fixing belt 22 are arranged at an inside in the front and rear direction of the meandering restriction ring 37 arranged in each belt attachment base 35 of the upper frame part 31. Thereby, meandering (movement to one side in the front and rear direction) of the fixing belt 22 is restricted.

The fixing belt 22 has a passing region 51 and non-passing regions 52 arranged at both front and rear side (outside in the front and rear direction) of the passing region 51. Through the passing region 51, a sheet of maximum size (for example, a sheet of A3 size) passes. Through the non-passing regions 52, the sheet of maximum size does not pass.

The pressuring roller 23 (refer to FIG. 2 and other figures) is formed in a roughly columnar shape elongated in the front and rear direction. The pressuring roller 23 is composed of, for example, a columnar core material 53, an elastic layer 54 provided around the core material 53 and a release layer (not shown) covering the elastic layer 54. The core material 53 of the pressuring roller 23 is made of, for example, metal, such as iron. The elastic layer 54 of the pressuring roller 23 is made of, for example, silicone rubber. The release layer (not shown) of the pressuring roller 23 is made of, for example, PFA tube.

The pressuring roller 23 is arranged at a lower side (an outer circumferential side) of the fixing belt 22. The pressuring roller 23 comes into pressure contact with the fixing belt 22 and, between the fixing belt 22 and the pressuring roller 23, a fixing nip 55 is formed. The pressuring roller 23 is rotatably supported by a center part in a longitudinal direction (in the embodiment, a center part in the left and right direction) of each swing frame 44 of the lower frame part 32. Each Swing frame 44 is swung around the fulcrum part 45 to move the pressuring roller 23 in the upper and lower direction so that the pressure of the fixing nip 55 is shifted.

The pressuring roller 23 is rotatable around a rotation axis B extending in the front and rear direction. That is, in the embodiment, a rotation axis direction of the pressuring roller 23 is the front and rear direction. Incidentally, as shown in a two-dot chain line Z in FIG. 2, in the embodiment, a direction connecting the rotation axis A of the fixing belt 22 and the rotation axis B of the pressuring roller 23 is upper and lower direction.

The heater 24 (refer to FIG. 2 and other figures) is composed of, for example, a halogen heater. The heater 24 is arranged at the upper side of the reflecting member 25, the supporting member 26 and the pressing member 28.

In other words, the heater 24 is arranged at the side further from the pressuring member 23 than the reflecting member 25, the supporting member 26 and the pressing member 28. Both front and rear end parts of the heater 24 are attached to the upper frame part 31.

The reflecting member 25 (refer to FIG. 2 and other figures) is formed in a shape elongated in the front and rear direction. The reflecting member 25 is made of a metal, such as an aluminum alloy for brightening, for example. The reflecting member 25 is arranged between the heater 24 and the supporting member 26. The reflecting member 25 is formed in a U shape which is convex upward.

The reflecting member 25 includes a first plate part 61 and a second plate part 62 which are provided along the upper and lower direction, and a third plate part 63 which is provided along the left and right direction and connects upper end parts of the first plate part 61 and the second plate part 62. The first plate part 61 is arranged at a right side (an upstream side in the sheet conveying direction) of the supporting member 26. The second plate part 62 is arranged at a left side (a downstream side in the sheet conveying direction) of the supporting member 26. An upper face (a heater 24 side face) of the third plate part 63 is a reflection face (mirror face) which reflects a radiant heat radiated from the heater 24 to an inner circumferential face of the fixing belt 22.

The supporting member 26 (refer to FIG. 4 and other figures) is formed in a shape elongated in the front and rear direction. The supporting member 26 is made of a sheet metal, such as an SECC (zinc-coated steel sheet).

The supporting member 26 is formed in a U shape which is convex upward.

The supporting member 26 is provided with a first supporting part 71 and a second supporting part 72 which are provided along the upper and lower direction, and a third supporting part 73 which is provided along the left and right direction and connects upper end parts of the first supporting part 71 and the second supporting part 72. The upper side parts of the first supporting part 71 and the second supporting part 72 and the third supporting part 73 are inserted into a space formed between the first plate part 61 and the second plate part 62 of the reflecting member 25.

Each spacer 27 (refer to FIGS. 2 and 3 and other figures) is made of a resin, such as LCP (liquid crystal polymer), PPS (polyphenylene sulfide) or PEEK (polyetheretherketone), for example.

Each spacer 27 includes a bottom wall part 74 and side wall parts 75 which are bent toward an upper side from both left and right end parts of the bottom wall part 74. The bottom wall part 74 is sandwiched between both front and rear end parts of the third plate part 63 of the reflecting member 25 and both front and rear end parts of the third supporting part 73 of the supporting member 26. According to this, the reflecting member 25 and the supporting member 26 do not come into contact with each other.

The pressing member 28 (refer to FIGS. 3 to 5 and other figures) is formed in a shape elongated in the front and rear direction. The pressing member 28 is made of heat resistant resin, such as LCP (liquid crystal polymer), for example. The pressing member 28 is supported from an upper side by the supporting member 26.

At a lower end part of a left face (a downstream side face in the sheet conveying direction) of the pressing member 28, a protruding piece 80 is protruded. The protruding piece 80 comes into contact with a lower end part of the second supporting part 72 of the supporting member 26. The upper side part of the pressing member 28 is inserted into a space formed between the first supporting part 71 and the second supporting part 72 of the supporting member 26.

A lower face (the fixing nip 55 side face) of the pressing member 28 is inclined toward a lower side (the pressuring roller 23 side) from a right side (an upstream side in the sheet conveying direction) to a left side (the downstream side in the sheet conveying direction). The lower face of the pressing member 28 presses the fixing belt 22 toward a lower side (the pressuring roller 23 side).

The pressing member 28 includes a first pressing part 81 and second pressing parts 82 arranged at both front and rear side (outside in the front and rear direction) of the first pressing part 81. The first pressing part 81 is arranged at an inner circumferential side of the passing region 51 of the fixing belt 22. Each second pressing part 82 is arranged at the inner circumferential side of each non-passing region 52 of the fixing belt 22.

The first pressing part 81 and the rear second pressing part 82 of the pressing member 28 have insertion parts 83 into which the temperature sensors 29 can be inserted. Each insertion part 83 is provided along the horizontal direction. At a left end part (a downstream side end part in the sheet conveying direction) of each insertion part 83, an opening 84 through which each temperature sensor 29 is inserted into each insertion part 83 is formed.

In the pressing member 28, a plurality of through holes 85 which penetrate from the lower face (the fixing nip 55 side face) to each insertion part 83 are formed along the upper and lower direction (vertical direction). A plurality of through holes 85 are a plurality of small holes provided densely, and arranged in a row at intervals in the left and right direction and the front and rear direction. Each through hole 85 is formed in a precise circular shape, for example. The diameter of each through hole 85 is 0.5 mm to 2 mm, for example, and a formation pitch of the through holes 85 (a distance from the center of one through hole 85 to the center of the other through hole 85 adjacent to the above-mentioned one through hole 85) is 0.5 mm to 1 mm, for example.

Each temperature sensor 29 is formed by a thermistor, for example. The front temperature sensor 29 is inserted into the insertion part 83 provided at the first pressing part 81 of the pressing member 28, and the rear temperature sensor 29 is inserted into the insertion part 83 provided at the rear second pressing part 82 of the pressing member 28. Each temperature sensor 29 is arranged more closely to the lower side (the pressuring roller 23 side) than a center part in the upper and lower direction of the pressing member 28 (refer to a one-dot chain line M in FIG. 4).

Figure 6:
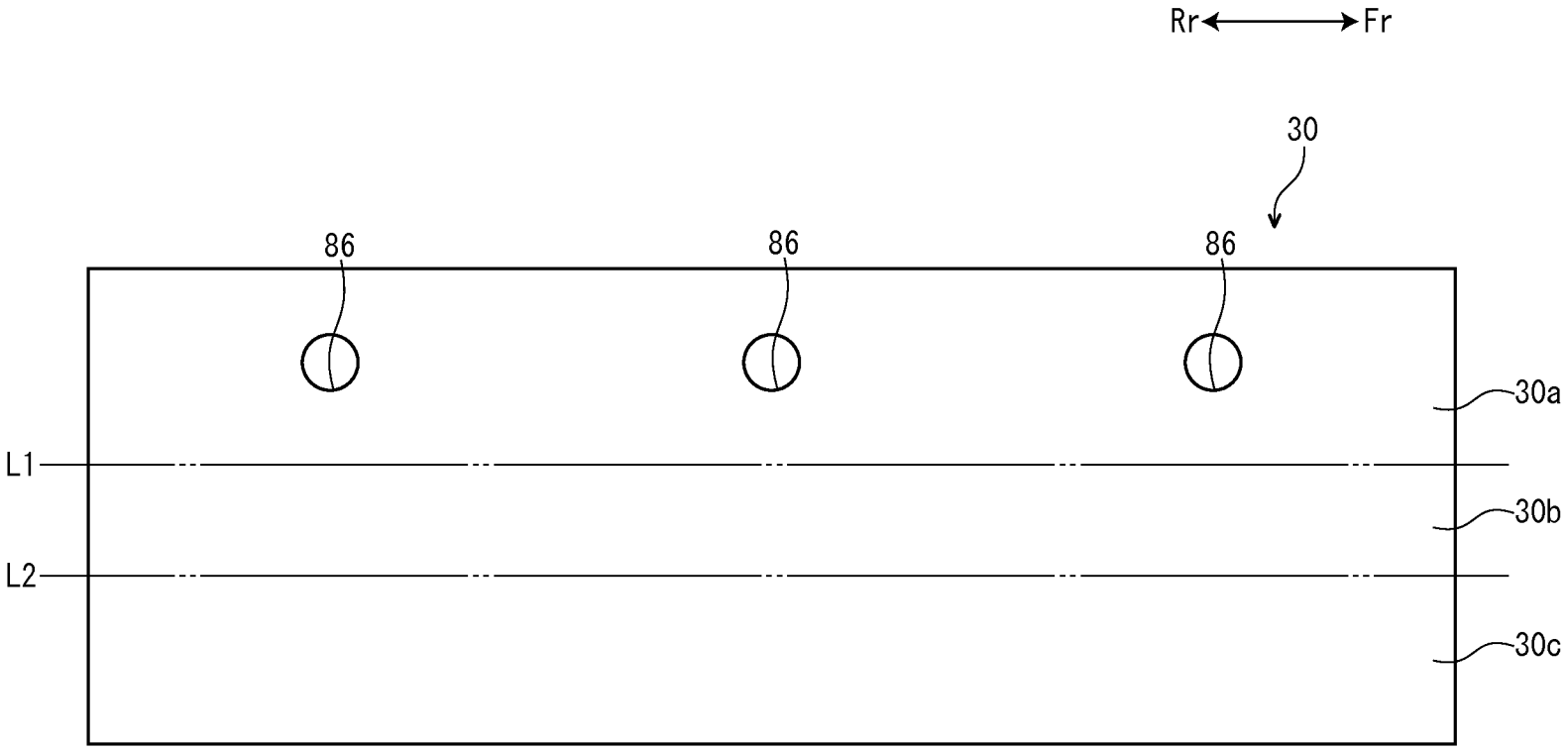
FIG. 6 is a plan view showing a sheet member in a developed state, in the fixing device according to the embodiment of the present disclosure.

The sheet member 30 (refer to FIGS. 4 and 6 and other figures) is made of a fluororesin, such as a PTFE, for example, and has a lower friction coefficient than that of the pressing member 28. The sheet member 30 is formed in a shape elongated in the front and rear direction. In addition, a two-dot chain line L1 in FIG. 6 indicates a boundary between a width direction one side part 30*a* and a width direction center part 30*b* of the sheet member 30, and a two-dot chain line L2 in FIG. 6 indicates a boundary between a width direction center part 30*b* and a width direction other side part 30*c* of the sheet member 30.

At the width direction one side part 30*a* of the sheet member 30, a plurality of attachment holes 86 are formed at intervals in the front and rear direction. The width direction one side part 30*a* of the sheet member 30 is fixed to the upper face (a face at a far side from the fixing nip 55) of the pressing member 28 by a screw 87 penetrating each attachment hole 86. The width direction center part 30*b* of the sheet member 30 is sandwiched between the first supporting part 71 of the supporting member 26 and a right face (an upstream side face in the sheet conveying direction) of the pressing member 28. The width direction other side part 30*c* of the sheet member 30 is sandwiched between the lower face (fixing nip 55 side face) of the pressing member 28 and the inner circumferential face of the fixing belt 22.

Figure 7:
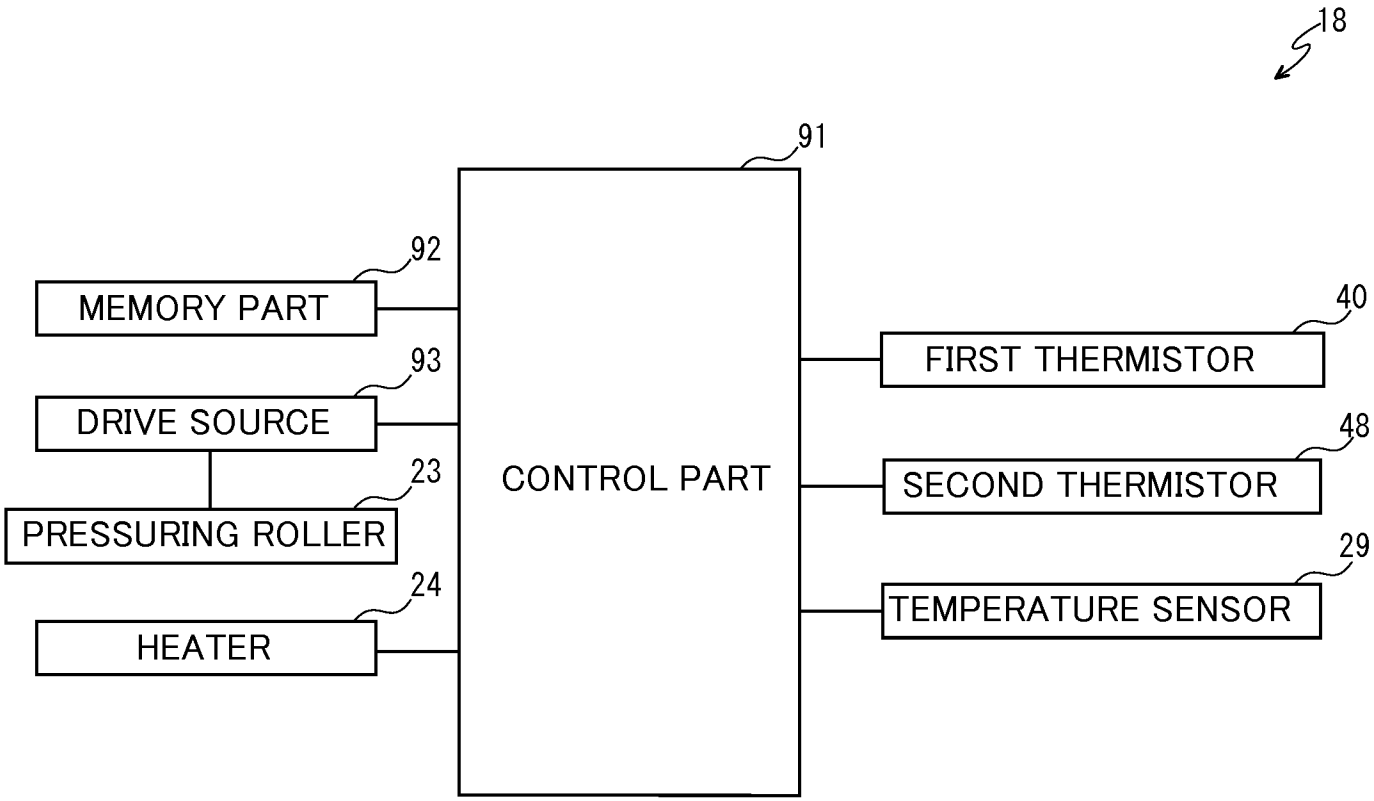
FIG. 7 is a block diagram showing an electrical configuration of the fixing device according to the embodiment of the present disclosure.

Next, an electrical configuration of the fixing device 18 will be described with reference to FIG. 7.

The fixing device 18 is provided with a control part 91. The control part 91 is connected with a memory part 92 composed of a memory device, such as a ROM or a RAM, and is configured to control each part of the fixing device 18 based on a control program or control data stored in the memory part 92.

The control part 91 is connected to a drive source 93 composed of a motor or the like, and the drive source 93 is connected to the pressuring roller 23. Further, the drive source 93 is configured to rotate the pressuring roller 23 based on a signal from the control part 91.

The control part 91 is connected to the heater 24. The heater 24 is energized based on a signal from the control part 91, generates heat and radiates a radiant heat.

The control part 91 is connected to each first thermistor 40, and the temperature of an outer circumferential face of the fixing belt 22 detected by each first thermistor 40 is output to the control part 91.

The control part 91 is connected to the second thermistor 48, and the temperature of the outer circumferential face of the pressuring roller 23 detected by the second thermistor 48 is output to the control part 91.

The control part 91 is connected to each temperature sensor 29, and the temperature of the sheet member 30 detected by each temperature sensor 29 is output to the control part 91.

In the fixing device 18 configured as described above, in order to fix the toner image onto the sheet, the drive source 93 rotates the pressuring roller 23 based on the signal from the control part 91. When the pressuring roller 23 is thus rotated, the fixing belt 22 coming into pressure contact with the pressuring roller 23 is co-rotated in an opposite direction to the pressuring roller 23. When the fixing belt 22 is thus rotated, the fixing belt 22 slides with respect to the sheet member 30.

In addition, in order to fix the toner image onto the sheet, the heater 24 is energized based on the signal from the control part 91, generates heat and radiates the radiant heat. A part of the radiant heat radiated from the heater 24 reaches directly the inner circumferential face of the fixing belt 22 as indicated by an arrow C in FIG. 2 and absorbed by the inner circumferential face of the fixing belt 22. Another part of the radiant heat radiated from the heater 24 is reflected by the upper face of the third plate part 63 of the reflecting member 25 toward the inner circumferential face of the fixing belt 22 as indicated by an arrow D in FIG. 2, and then, is absorbed by the inner circumferential face of the fixing belt 22. According to action as mentioned above, the fixing belt 22 is heated by the heater 24. In such a situation, when the sheet passes through the fixing nip 55, the toner image is heated and molten, thereby fixing the toner image onto the sheet.

By the way, when the sheet member 30 is made of fluororesin, such as PTFE as described above, a heat resistant temperature of the sheet member 30 is about 200° C. Further, when the pressing member 28 is made of heat resistant resin, such as LCP, as described above, a heat resistant temperature of the pressing member 28 is about 200° C. to 400° C. Thus, according to the present embodiment, the heat resistant temperatures of the sheet member 30 and the pressing member 28 are relatively low. Particularly when the temperature of the sheet member 30 exceeds the heat resistant temperature, the sheet member 30 rapidly deteriorates, and, according to this, there is a concern that the operating life of the fixing device 18 shortens. In addition, while a sheet takes away a heat in the passing region 51 of the fixing belt 22, a sheet does not take away a heat in the non-passing regions 52 of the fixing belt 22. Therefore, the temperatures at the both end parts in the front and rear direction (the non-passing region 52 side parts) of the sheet member 30 are likely to rise higher than the temperature of a center part in the front and rear direction (the passing region 51 side part) of the sheet member 30. Hence, according to the present embodiment, the temperature of the sheet member 30 is prevented from exceeding the heat resistant temperature as follows.

When the temperature of the sheet member 30 outputted from each temperature sensor 29 is less than the heat resistant temperature stored in the memory part 92, the control part 91 continues an operation of fixing toner image onto the sheet at a fixed speed (the number of sheets per unit time). Meanwhile, when the temperature of the sheet member 30 outputted from one of the temperature sensors 29 (particularly, the temperature sensor 29 inserted into the rear second pressing part 82 of the pressing member 28) reaches the heat resistant temperature or more stored in the memory part 92, the control part 91 stops the operation of fixing toner image onto the sheet or lowers a rate of the operation of fixing toner image onto the sheet compared to the above-mentioned speed. Thus, it is possible to prevent the temperature of the sheet member 30 from exceeding the heat resistant temperature.

Further, according to the present embodiment, a plurality of through holes which penetrate from the lower face (the fixing nip 55 side face) to the insertion part 83 of each temperature sensor 29 are formed in the pressing member 28. By applying this configuration, each temperature sensor 29 can accurately detect the temperature of the sheet member 30.

Further, a plurality of through holes 85 are a plurality of small holes provided densely, so that it is possible to prevent the pressure of the fixing nip 55 from being uneven when the through holes 85 are formed.

Figure 4:
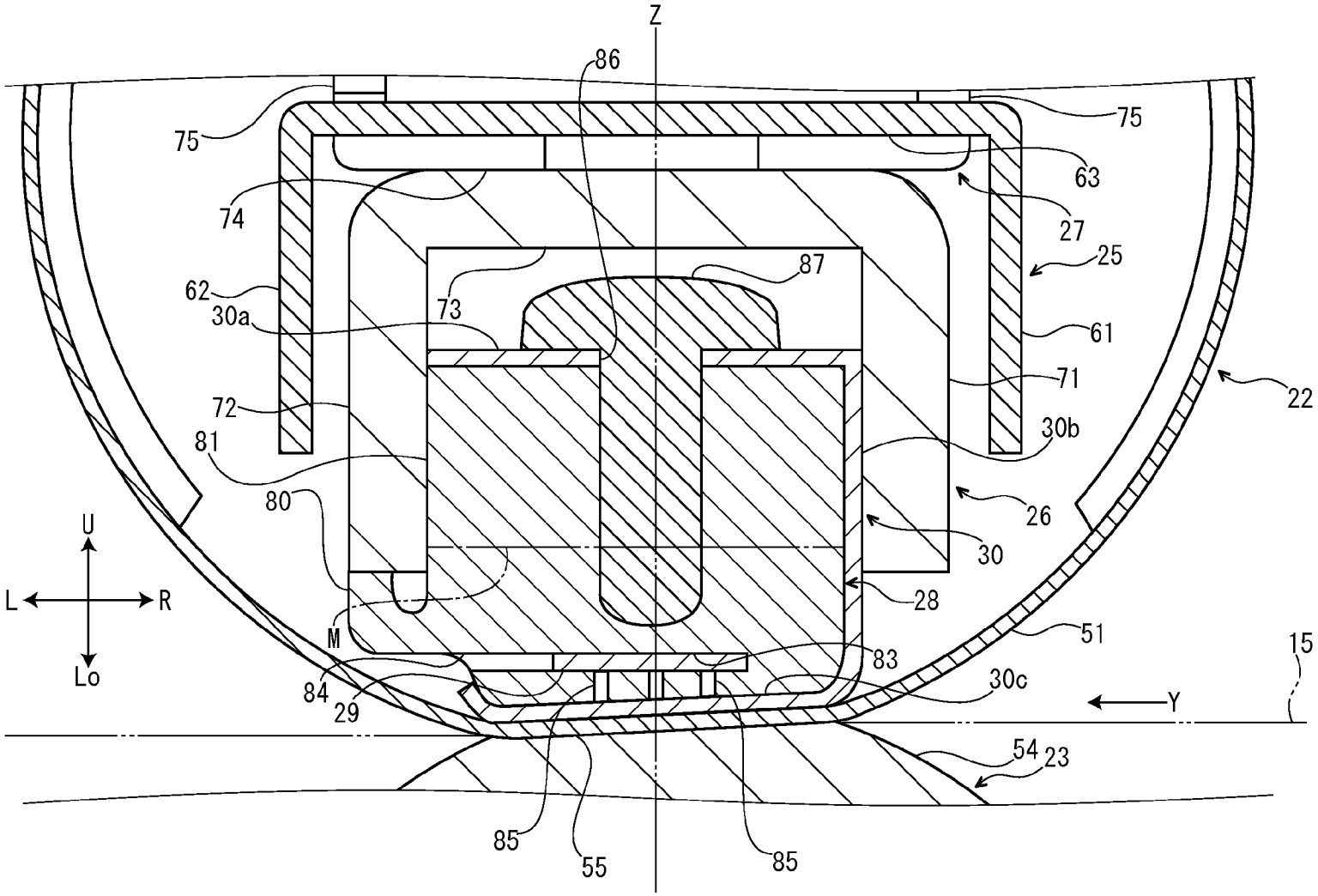
FIG. 4 is a sectional view showing a pressing member and its peripheral, in the fixing device according to the embodiment of the present disclosure.
Figure 5:
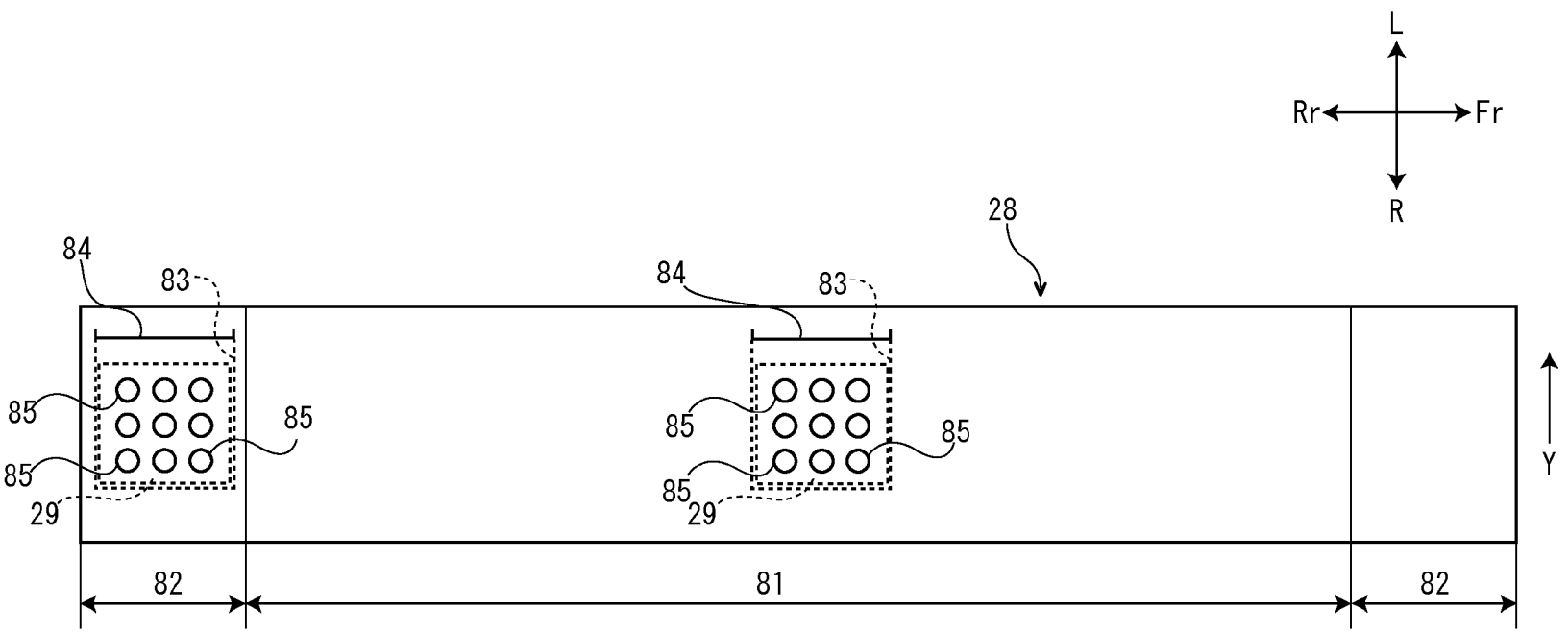
FIG. 5 is a bottom view showing the pressing member and a temperature sensor, in the fixing device according to the embodiment of the present disclosure.

Further, each temperature sensor 29 is arranged more closely to the lower side (the pressuring roller 23 side) than a center part in the upper and lower direction of the pressing member 28 (refer to a one-dot chain line M in FIG. 4). By applying this configuration, each temperature sensor 29 can more accurately detect the temperature of the sheet member 30.

Further, into the first pressing part 81 and the second pressing part 82 of the pressing member 28, the temperature sensors 29 are inserted, respectively. Consequently, each temperature sensor 29 can more reliably detect the temperature of the center part in the front and rear direction (the passing region 51 side part) and the both end parts in the front and rear direction (the non-passing regions 52 side parts) of the sheet member 30.

Further, between the fixing belt 22 and the pressing member 28, the sheet member 30 having the lower friction coefficient than that of the pressing member 28 is arranged. By applying this configuration, it is possible to reduce a sliding load of the fixing belt 22.

Further, at the left end part (the downstream end part in the sheet conveying direction) of each insertion part 83, the opening 84 through which each temperature sensor 29 is inserted into each insertion part 83 is formed. By applying this configuration, each temperature sensor 29 can be easily inserted into each insertion part 83.

Further, the lower face of the pressing member 28 is inclined toward the lower side from the right side to the left side. According to this, the fixing nip 55 is also inclined toward the lower side from the right side to the left side, so that it is possible to improve performance to separate the sheet from the fixing belt 22. Furthermore, each insertion part 83 is provided along the horizontal direction, so that each insertion part 83 can stably support each temperature sensor 29. As described above, according to the present embodiment, while the lower face of the pressing member 28 and the fixing nip 55 are inclined, each insertion part 83 is provided along the horizontal direction. Consequently, it is possible to stably support each temperature sensor 29 while securing the performance to separate the sheet from the fixing belt 22.

In the present embodiment, a case where, at the left end part (the downstream side end part in the sheet conveying direction) of each insertion part 83, the opening 84 is formed has been described. However, in another embodiment, at the right end part (the upstream side end part in the sheet conveying direction) of each insertion part 83, the opening 84 may be formed.

In the present embodiment, a case where, into the first pressing part 81 and the second pressing part 82 of the pressing member 28, the temperature sensors 29 are inserted respectively has been described. However, in another embodiment, into one of the first pressing part 81 and the second pressing part 82 of the pressing member 28, the temperature sensor 29 may be inserted.

Figure 8:
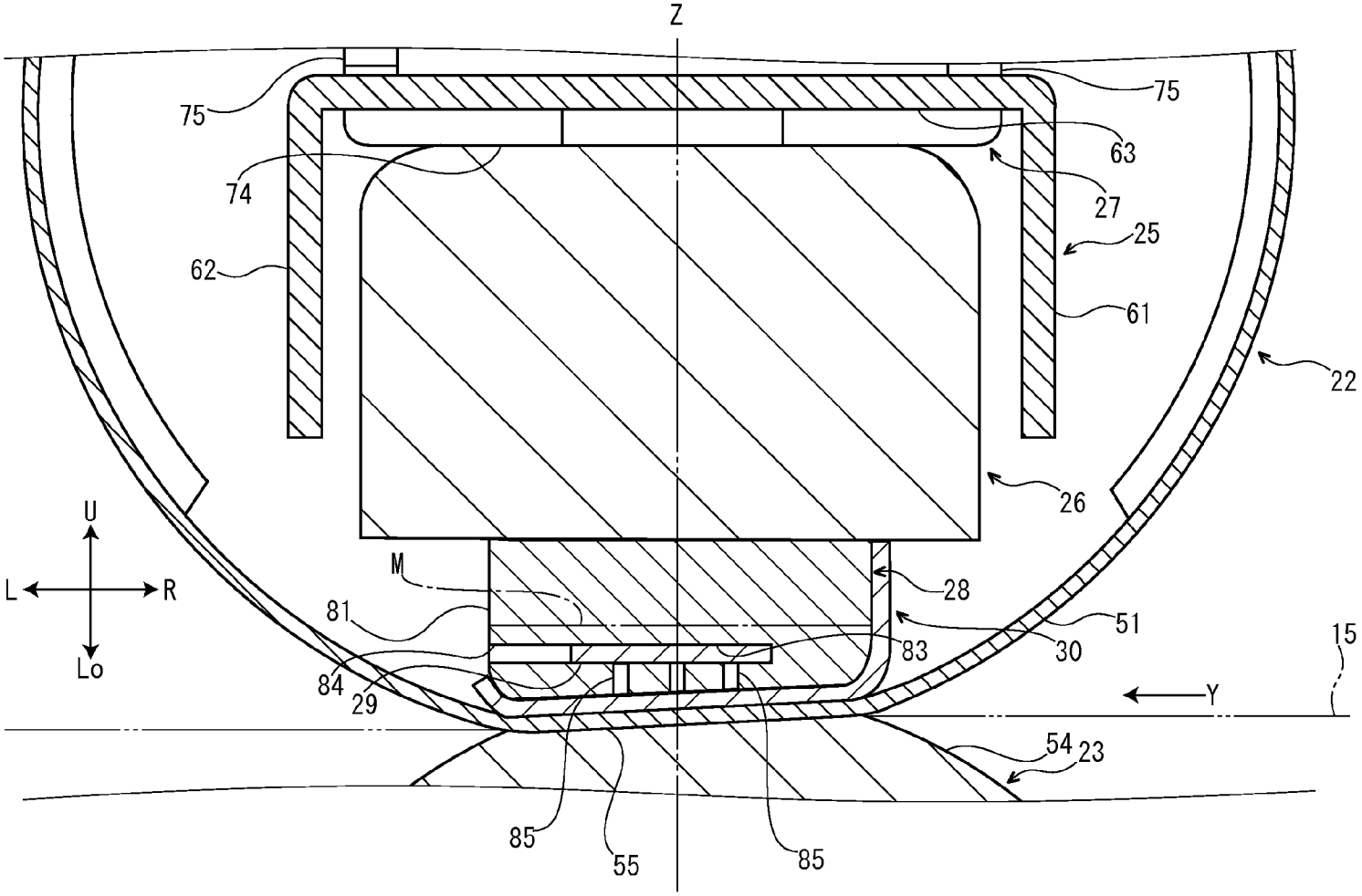
FIG. 8 is a sectional view showing a pressing member and its peripheral, in a fixing device according to another embodiment of the present disclosure.

In the present embodiment, a case where the supporting member 26 is made of a sheet metal has been described. However, in another embodiment, as shown in FIG. 8, the supporting member 26 may be made of a material of a block shape. Even when this configuration is applied, to enable each temperature sensor 29 to accurately detect the temperature of the sheet member 30, each temperature sensor 29 is preferably arranged more closely to the lower side (the pressuring roller 23 side) than a center part in the upper and lower direction of the pressing member 28 (refer to a one-dot chain line M in FIG. 8)

Figure 9A:
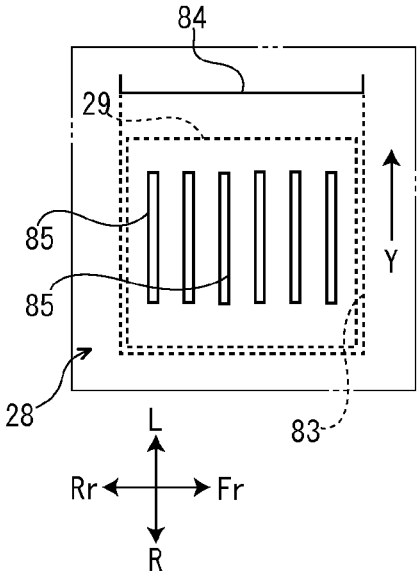
FIGS. 9A-9E are bottom views showing shapes of through holes, in fixing devices according to other embodiments of the present disclosure.
Figure 9B:
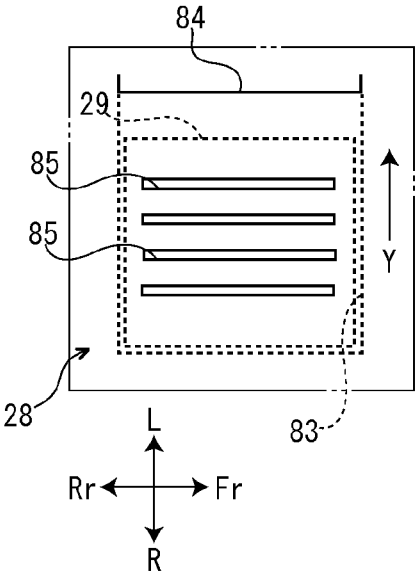

In the present embodiment, a case where a plurality of through holes 85 are a plurality of small holes provided densely has been described. Meanwhile, in another embodiment, as shown in FIG. 9A, a plurality of through holes 85 may be a plurality of elongated holes extending along the left and right direction (sheet conveying direction), and may be arranged in a row at intervals in the front and rear direction (a direction crossing to the sheet conveying direction). Further, as shown in FIG. 9B, a plurality of through holes 85 may be a plurality of elongated holes extending along the front and rear direction (a direction crossing to the sheet conveying direction) and may be arranged in a row at intervals in the left and right direction (sheet conveying direction). By applying the configuration shown in FIG. 9A or 9B, similar to the present embodiment, it is possible to prevent the pressure of the fixing nip 55 from being uneven when the through holes 85 are formed.

Figure 9C:
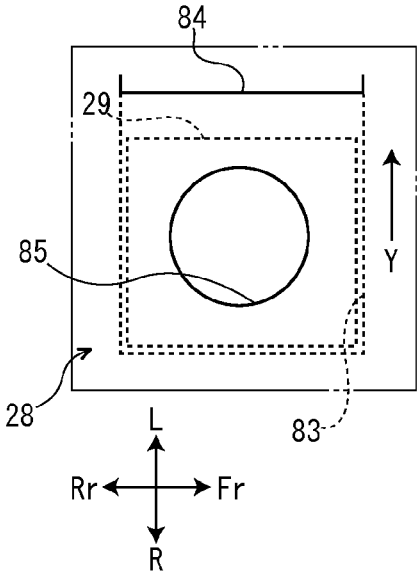
Figure 9D:
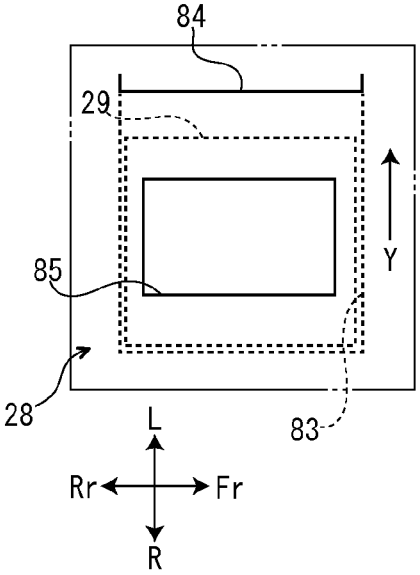
Figure 9E:
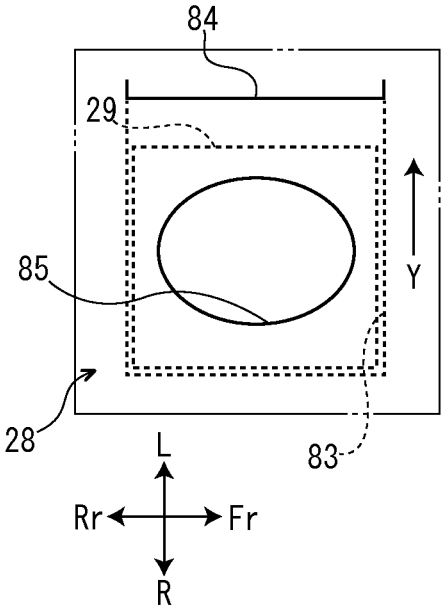

In the present embodiment, a case where a plurality of through holes 85 are formed corresponding to each insertion part 83 has been described. Meanwhile, in another embodiment, as shown in FIG. 9C, one through hole 85 of a precise circular shape may be formed corresponding to each insertion part 83. As shown in FIG. 9D, one through hole 85 of a polygonal shape (e.g. square shape) may be formed corresponding to each insertion part 83. As shown in FIG. 9E, one through hole 85 of an elliptical shape may be formed corresponding to each insertion part 83.

In the present embodiment, a case where each through hole 85 is formed in a precise circular shape has been described. In another embodiment, each through hole 85 may be formed in shapes such as an elliptical shape and a polygonal shape other than the precise circular shape.

In the present embodiment, a case where the sheet member 30 is arranged between the fixing belt 22 and the pressing member 28 has been described. In another embodiment, the sheet member 30 may not be arranged between the fixing belt 22 and the pressing member 28, and the fixing belt 22 and the pressing member 28 may come into contact with each other.

In the present embodiment, a case of using the halogen heater as the heater 24 has been described. In another embodiment, a ceramic heater or the like may be used as the heater 24.

The embodiment was described in a case of applying the configuration of the present disclosure to the printer 1. In another embodiment, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably;

a pressuring member arranged rotatably and configured to come into pressure contact with the fixing belt so as to form a fixing nip;

a pressing member configured to press the fixing belt to the pressuring member side; and a temperature sensor inserted into the pressing member, wherein the pressing member has a through hole penetrating from a face at the fixing nip side to an insertion part of the temperature sensor, wherein the insertion part is opened to a downstream side in a conveying direction of a recording medium, wherein length of the insertion part in the conveying direction of the recording medium is longer than length of the through hole in the conveying direction of the recording medium.

2. The fixing device according to claim 1, wherein the through hole is formed in a polygonal shape.

3. The fixing device according to claim 1, wherein the through hole is formed in an elliptical shape.

4. The fixing device according to claim 1, wherein the temperature sensor is arranged more closely to the pressuring member than a center part of the pressing member in a direction connecting a rotation axis of the fixing belt and a rotation axis of the pressuring member.

5. The fixing device according to claim 1, wherein the fixing belt has:

a passing region through which the recording medium passes; and a non-passing region arranged outside the passing region in a direction of a rotation axis of the fixing belt, the pressing member has:

a first pressing part arranged at an inner circumferential side of the passing region; and a second pressing part arranged outside the first pressing part in the direction of the rotation axis of the fixing belt and arranged at an inner circumferential side of the non-passing region, there are a plurality of the temperature sensors, each of the temperature sensors inserted into the first pressing part and the second pressing part, respectively.

6. The fixing device according to claim 1, further comprising a sheet member arranged between the fixing belt and the pressing member and having a lower friction coefficient than that of the pressing member.

7. The fixing device according to claim 1, wherein an opening through which the temperature sensor is inserted into the insertion part is formed at a downstream end part of the insertion part in the conveying direction of the recording medium.

8. An image forming apparatus comprising the fixing device according to claim 1.

* * * * *